US005114257A

United States Patent [19]

Hsu

[11] Patent Number: 5,114,257

[45] Date of Patent: May 19, 1992

[54] WRITING APPARATUS WITH STAPLER INCORPORATED THEREIN

[76] Inventor: Nick Hsu, 5F., No. 44, Alley 3, Lane 550, Minchuan E. Rd., Taipei, Taiwan

[21] Appl. No.: 669,703

[22] Filed: Mar. 15, 1991

[51] Int. Cl.[5] ..... B26B 11/00; B43K 29/00; B43K 25/00; B25C 7/00

[52] U.S. Cl. ..... 401/195; 401/52; 7/160; 7/170; 227/156

[58] Field of Search ..... 227/156; 7/160, 170; 401/195, 52, 6

[56] References Cited

U.S. PATENT DOCUMENTS 1,404,138 1/1922 Perrotti ..... 401/52
2,295,603 9/1942 Purchard ..... 401/52 X
2,695,407 11/1954 Goodstein ..... 227/156

FOREIGN PATENT DOCUMENTS 899727 6/1962 United Kingdom ..... 401/195

*Primary Examiner*—Danton D. Demille
*Attorney, Agent, or Firm*—Varndell Legal Group

[57] ABSTRACT

A writing apparatus comprising a penholder with a ball refill retained therein for writing, and a staple driving mechanism incorporated therein for driving staples through paper as for binding pamphlets. The penholder of the writing apparatus comprises an elongated cartridge received inside an outer cylinder for holding ball refill and staples. The outer cylinder is comprised of two parts pivoted together, wherein the lower part has a matrix matching with the striking plate on the upper part for performing staple driving process. Two plate springs are provided to support the upper and lower parts of the outer cylinder in an opened position. A lock cap is pivoted to the lower part for releasably locking the upper and lower parts together when the staple driving mechanism is not in use.

2 Claims, 4 Drawing Sheets

WRITING APPARATUS WITH STAPLER INCORPORATED THEREIN

BACKGROUND OF THE INVENTION

The present invention relates to writing apparatus, and more particularly relates to a writing apparatus with stapler incorporated therein which comprises an outer penholder which is comprised of two parts pivoted together with one incorporated with a striking plate and the other incorporated with a matrix for driving staples out of an inner penholder for binding pamphlets.

Many writing apparatus manufacturers have been trying every method to fully utilize the space of the penholder of a writing apparatus. For examples, pen watch is to incorporate a watch into a pen, pen lighter is to incorporate a lighter to a pen. In German Patent No. G8815691.5, there is disclosed a pen and stapler combination set, as shown in FIGS. 1 and 2, in which a mini-stapler is attached to the top end of a ball-point pen for binding pamphlets. However, this structure is not satisfactory in use because it is just merely attach a regular mini-stapler to a pen. One disadvantage of this structure is that it occupies much space and is not convenient for carrying because the staple driving mechanism is disposed externally at one end of the pen. Another disadvantage of this structure is that it is not inconvenient in writing due to heavy load of the staple driving mechanism at the top end of the pen opposite to the ball-point nib of the ball refill therein. Still another disadvantage of this structure is that the two pivoted plates of the staple driving mechanism may be detached from each other easily when they are relatively bent to open during operation. Still another disadvantage of this structure is that the ball refill may be erroneously triggered when the writing apparatus is fastened in one's pocket, causing the ball-point nib thereof to project out of the penholder to further contaminate the clothes.

The present invention has been accomplished under the circumstances in view. It is therefore an object of the present invention to provide a writing apparatus with stapler incorporated therein which is practical in use and convenient for carrying. It is still another object of the present invention to provide a writing apparatus with stapler incorporated therein wherein the stapler is protected from outside when it is not in use.

SUMMARY OF THE INVENTION

According to the present invention, there is provided a writing apparatus comprising an outer cylinder having two parts pivoted together for holding a ball refill holder which is simultaneously serving as a staple cartridge. Two plate springs are provided to support the two pivoted parts of the outer cylinder in a relatively opened position. A stop plate is made inside the ball refill holder to firmly retain the ball refill in position. A striking plate and a matrix are respectively attached to the two pivoted parts of the outer cylinder for performing staple binding process. A lock cap is provided to lock the two pivoted parts together when the staple driving mechanism is not in use.

DETAILED DESCRIPTION OF THE PREFERRED EMBODIMENT

Figure 1:
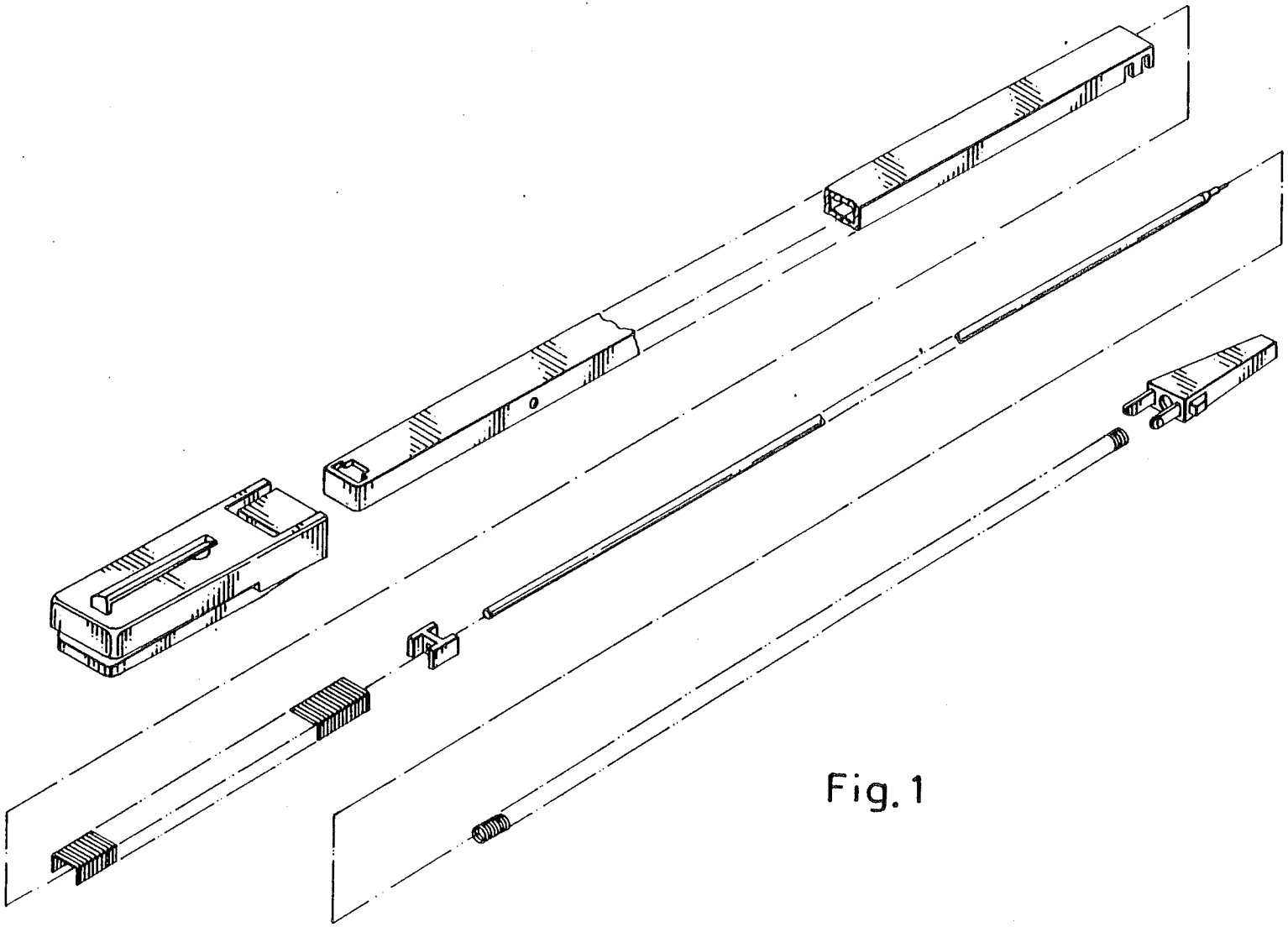
FIG. 1 is a perspective dismantled view of a writing apparatus with stapler according to the prior art.
Figure 2:
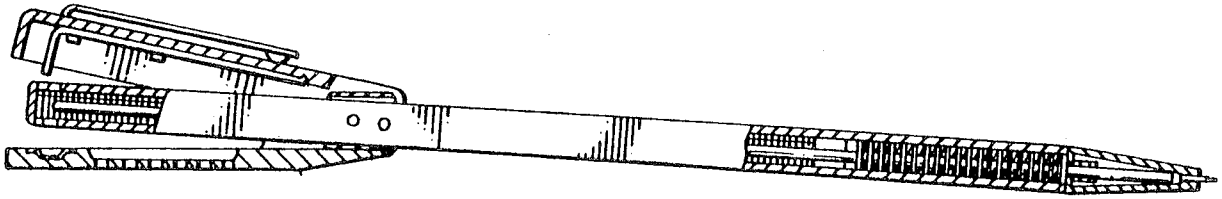
FIG. 2 is a perspective assembly and partly sectional view of the writing apparatus with stapler shown in FIG. 1.
Figure 3:
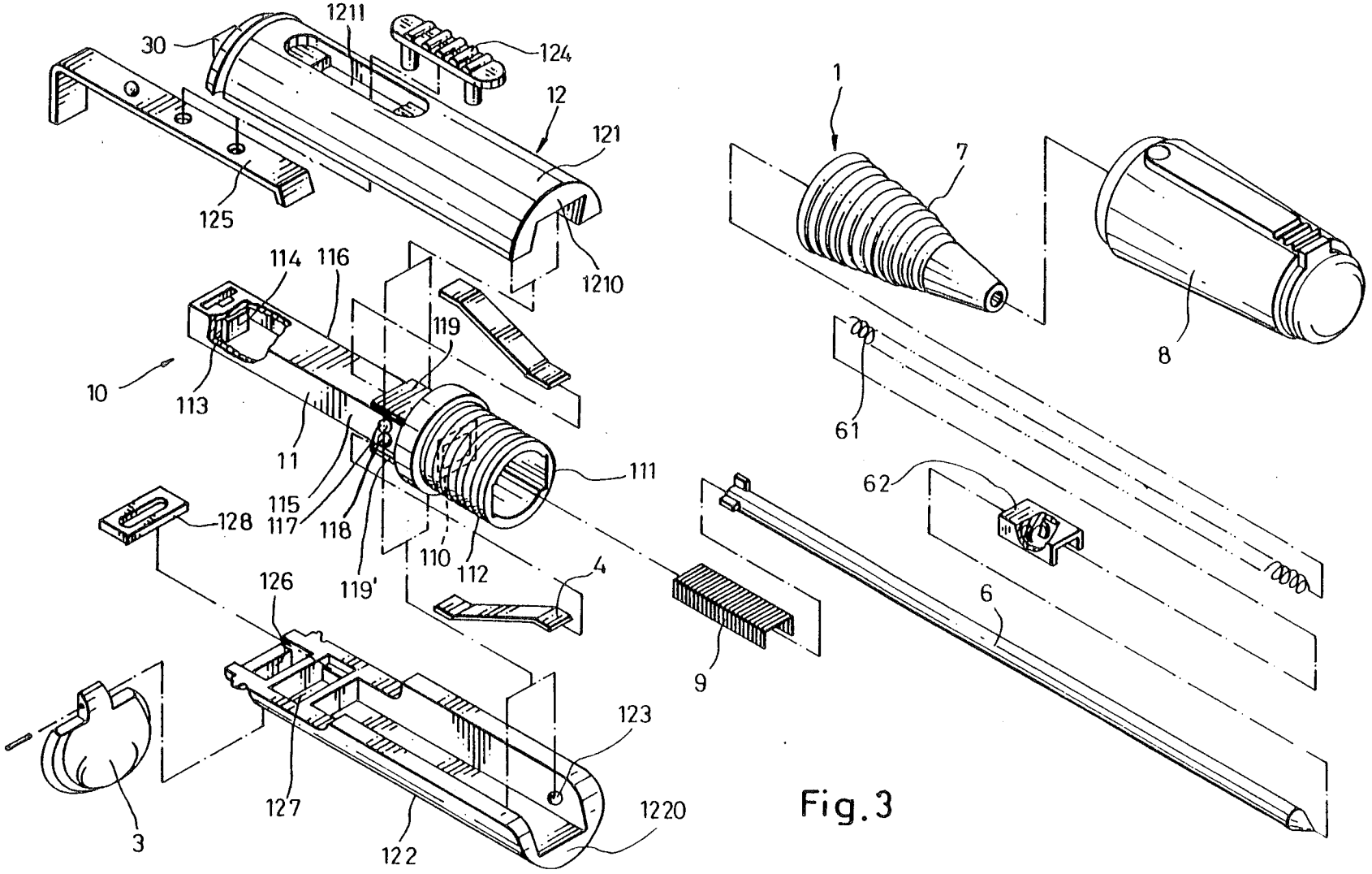
FIG. 3 is a perspective dismantled view of the preferred embodiment of the present invention.
Figure 4:
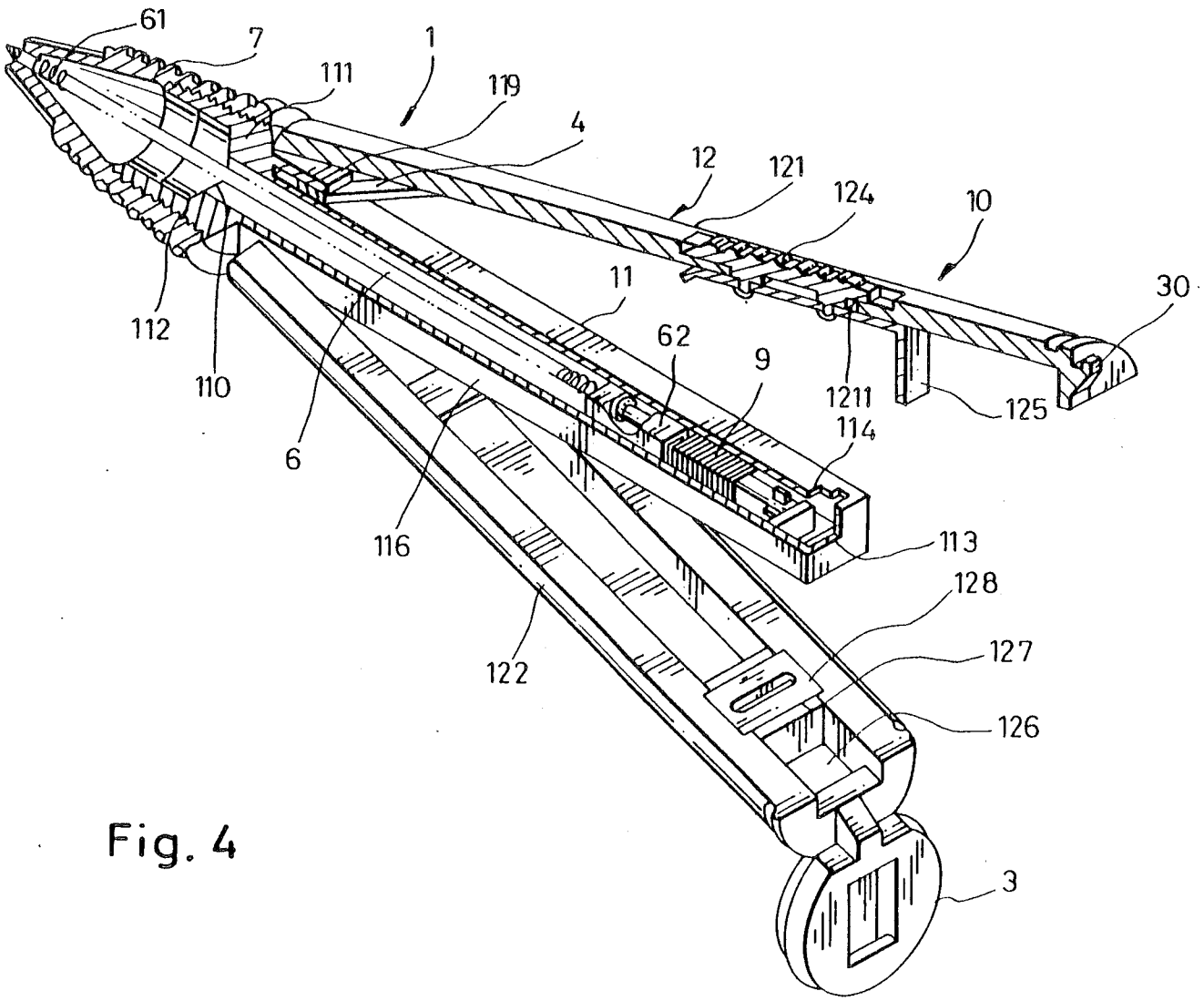
FIG. 4 is a perspective assembly and partly sectional view of the preferred embodiment of the present invention.

Referring to FIG. 3, there is shown the preferred embodiment of the writing apparatus 1 of the present invention in which the penholder which is designated at 10 is generally comprised of a ball refill holder 11 and an outer cylinder 12. The ball refill holder 11 is an elongated cartridge defining therein a channel at the top for mounting staples 9, having an outer thread 112 on a hollow cylinder 111 at the staple feeding end 110 thereof for mounting a front socket 7 through screw joint which front socket 7 is further covered with a cap 8. A ball refill 6 is longitudinally set in the channel of the elongated cartridge of the ball refill holder 11 with a spring 61 and a feed slide 62 mounted thereon to automatically push the staples 9 into a striking position. A staple outlet hole 113 is made on the ball refill holder 11 at the end opposite to the staple feeding 110 through which staple can be driven out for binding paper. A stop plate 114 which allows staples 9 to slide thereover during striking process is made inside the ball refill holder 11 near the staple outlet hole 113 to stop the ball refill 6 in position. The outer cylinder 12 is comprised of two symmetrical parts 121 and 122 having each two opposite pivot holes 123 for mounting the ball refill holder 11 which has two raised portions 117 and 118 on each of the two opposite side walls 115 and 116 thereof. By fastening the raised portions 117 and 118 in the pivot holes 123, the two symmetrical parts 121 and 122 are respectively secured to the ball refill holder 11. Two clamping plates 119 and 119' are respectively mounted in the hollow cylinder 111 at two opposite locations for holding two plate springs 4 which support the two symmetrical parts 121 and 122 in a relatively opened position, permitting the ends 1210 and 1220 of the two symmetrical parts 121 and 122 near the raised portions 117 and 118 or the pivot holes 123 thereof to respectively pivot to the hollow cylinder 111 of the ball refill holder 11. Further, there is a sliding slot 1211 made on the upper part 121 of the outer cylinder 12 for mounting a slide button 124 to movably secure a striking plate 125 thereto, a receiving trough 126 and a bearing trough 127 respectively made on the lower part 122 of the outer cylinder 12. The receiving trough 126 is provided for keeping staples and the bearing trough 127 is provided for mounting a matrix 128 to match the striking plate 125 for performing staple binding process. There is also a lock cap 3 pivotably connected to the lower part 122 of the outer cylinder 12 at the end 1220. When the upper and lower parts 121 and 122 are connected together, the lock cap 3 is locked by a hook 30 on the end 1210 of the upper part 121 to firmly retain the outer cylinder 12 into shape permitting the ball refill holder 11 to be completely concealed out of view. When not in use, the cap is attached to the front socket 7 with the outer wall surface thereof fitting flush with the outer wall surface of the outer cylinder 12.

I claim:

1. A writing apparatus comprising a penholder with a ball refill retained therein for writing, and a staple driving mechanism incorporated therein for driving staples through paper as for binding pamphlets, characterized in that:

said penholder is comprised of a ball refill holder set inside an outer cylinder, said ball refill holder being an elongated cartridge having one end closed and an opposite end opened for feeding of staples, a channel defined therein for keeping said ball refill and said staples, an outer thread on said opened end for mounting a front socket through screw joint through which the ball-point nib of said ball refill projects for writing, a staple outlet hole in communicating with said channel through which said staples can be driven out, two clamping plates respectively mounted on the top and the bottom thereof for holding two plate springs, said outer cylinder being comprised of an upper part and a lower part having each an end pivoted to said opened end of said ball refill holder and an opposite end respectively supported by said plate spring to space from each other, said upper part having a striking plate movably secured therein by a sliding button and controlled by said upper part to strike said staples out of said staple outlet hole for binding paper, said lower part having a receiving trough for keeping space staples, a matrix mounting seat for mounting a matrix to match with said striking plate for performing staple driving operation, and a lock cap pivoted thereto for releasably securing said upper part to said lower part.

2. The writing apparatus of claim 1, wherein said ball refill holder has a stop plate made therein near said staple outlet hole to stop said ball refill in position which allows staples to slide thereover during striking process.

* * * * *